US010065425B2

(12) United States Patent
Hagen et al.

(10) Patent No.: US 10,065,425 B2
(45) Date of Patent: Sep. 4, 2018

(54) PRINTING FLUID CONTAINER

(71) Applicant: Hewlett-Packard Development Company, L.P., Houston, TX (US)

(72) Inventors: David M. Hagen, Corvallis, OR (US); Brad Benson, Corvallis, OR (US); Patrick V. Boyd, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/519,716

(22) PCT Filed: Mar. 6, 2015

(86) PCT No.: PCT/US2015/019204

§ 371 (c)(1),
(2) Date: Apr. 17, 2017

(87) PCT Pub. No.: WO2016/144295

PCT Pub. Date: Sep. 15, 2016

(65) Prior Publication Data

US 2017/0253043 A1 Sep. 7, 2017

(51) Int. Cl.

| | |
|---|---|
| ***B41J 2/165*** | (2006.01) |
| ***B41J 2/175*** | (2006.01) |
| *B41J 2/055* | (2006.01) |

(52) U.S. Cl.

CPC ..... *B41J 2/16526* (2013.01); *B41J 2/17513* (2013.01); *B41J 2/17523* (2013.01); *B41J 2/17553* (2013.01); *B41J 2/055* (2013.01); *B41J 2002/16529* (2013.01); *B41J 2002/17516* (2013.01)

(58) Field of Classification Search

CPC ..... B41J 2/16526; B41J 2/17513; B41J 2/17553; B41J 2/055; B41J 2002/16529; B41J 2002/17516

USPC ..... 347/86

See application file for complete search history.

(56) References Cited

U.S. PATENT DOCUMENTS

| | | | | |
|---|---|---|---|---|
| 5,409,134 | A * | 4/1995 | Cowger | B41J 2/17506 222/1 |
| 6,739,710 | B2 | 5/2004 | Lin et al. | |
| 6,966,639 | B2 | 11/2005 | Martinez-Pacheco | |
| 7,984,980 | B2 | 7/2011 | Kachi | |

(Continued)

FOREIGN PATENT DOCUMENTS

| | | |
|---|---|---|
| CN | 1347804 | 5/2002 |
| CN | 1607094 | 4/2005 |

(Continued)

OTHER PUBLICATIONS

Burt, Bob, "Refilling inkjet cartridges", PC Update Online, Jun. 1996, pp. 1-2.

(Continued)

*Primary Examiner* — Huan Tran
*Assistant Examiner* — Alexander D Shenderov
(74) *Attorney, Agent, or Firm* — Dierker & Kavanaugh

(57) ABSTRACT

In one example, a container for holding printing fluid includes a chamber to hold a printing fluid and an inelastic, expandable, and contractible bag occupying space in the chamber. The exterior of the bag is exposed to an interior of the chamber and an interior of the bag is sealed against the interior of the chamber and vented to the atmosphere.

15 Claims, 7 Drawing Sheets

(56) References Cited

U.S. PATENT DOCUMENTS

| | | | |
|---|---|---|---|
| 2006/0164473 | A1 | 7/2006 | Davis et al. |
| 2006/0290753 | A1 | 12/2006 | Tatsumi et al. |
| 2009/0058956 | A1 | 3/2009 | Davis et al. |
| 2013/0141497 | A1 | 6/2013 | Boyd et al. |
| 2013/0201263 | A1 | 8/2013 | Stathem et al. |

FOREIGN PATENT DOCUMENTS

| | | |
|---|---|---|
| CN | 103282209 | 9/2013 |
| CN | 204109563 | 1/2015 |
| EP | 1093922 | 4/2001 |
| EP | 1524119 | 4/2005 |

OTHER PUBLICATIONS

International Search Report and Written Opinion for International Application No. PCT/US2015/019204 dated Oct. 29, 2015, 14 pages.

* cited by examiner

PRINTING FLUID CONTAINER

BACKGROUND

In many inkjet type dispensers, ink or other printing fluid is supplied to a printhead through a container that is maintained at a slight internal vacuum to help keep printing fluid from leaking out of the container. This internal vacuum in an inkjet printing fluid container is commonly referred to as "back pressure." The container may be integral to the printhead or separate from the printhead.

BRIEF DESCRIPTION OF THE DRAWINGS

FIG. 1A shows the container under normal conditions in which the bag is fully inflated. FIG. 1B shows the container in an abnormal condition in which the bag is contracted.

The same part numbers designate the same or similar parts throughout the figures.

DETAILED DESCRIPTION

Inkjet printing fluid containers can be subjected to a wide range of environmental conditions during manufacturing, storage, and shipping as well as during printing operations. Some environmental conditions cause high pressures inside the container. For example, printing fluid freezing at low temperatures may expand to pressurize the container, causing fluid leaks and even damaged parts. When frozen printing fluid thaws, the pressure from trapped air can further stress the container. High altitude and high temperature environments can induce similarly high, potentially damaging internal pressures.

The present disclosure provides examples of containers that may reduce the risk of excessive internal pressures. In one example, a container utilizes an unrestrained, inelastic, expandable and contractible bag inside the fluid chamber to help absorb large pressure excursions. The interior of the bag is vented to the atmosphere so that the bag is inflated to full expansion under normal conditions in which a small back pressure is maintained inside the fluid chamber. The contractible bag may relieve excess pressure inside the chamber by providing space for expanding air and ice. An inelastic bag with little or no shape memory may begin to deflate and contract as soon as the chamber reaches a positive pressure, keeping the inside the chamber at or near atmospheric pressure until the bag is fully deflated.

Unlike spring bags and elastic balloons used to regulate back pressure, in some examples the bags of the present disclosure may be constructed to have no appreciable effect on the pressure inside the chamber under normal conditions. Uncontained empty space (without a bag) has a lower compressibility than a vented bag. Pressure inside the chamber may rise even as empty space is consumed. With a vented bag, by contrast, pressure inside the chamber may not increase until the bag is fully contracted. Thus, more uncontained empty space may be needed to achieve the same protection as a vented bag. Accordingly, a vented bag may, for example, allow higher fluid fill levels.

A "printing fluid" as used in this document means fluids that are suitable for use in an inkjet type dispenser. "Printing fluid" is not limited to ink but also includes other fluids that may be used in an inkjet type dispenser and/or for uses other than printing images, including, for example, 3D printing agents and pharmaceutical agents dispensed from an inkjet type dispenser used in some digital titration machines.

The examples shown in the figures and described herein illustrate but do not limit the scope of the patent, which is defined in the Claims following this Description.

Figure 1B:
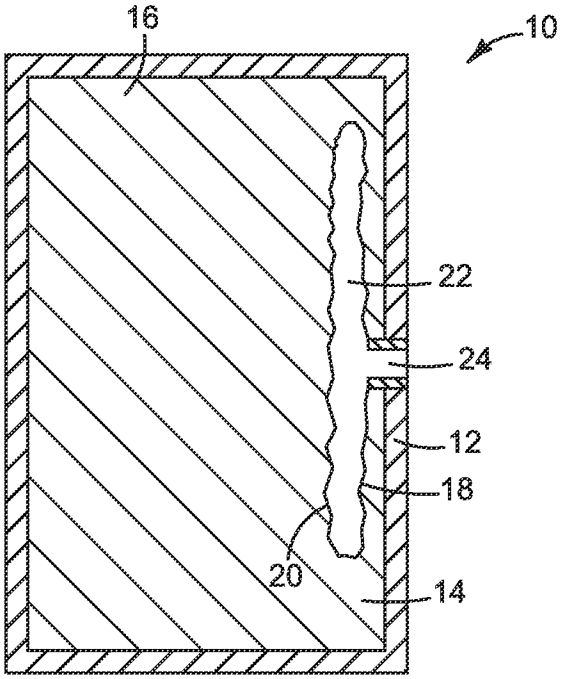
FIGS. 1A and 1B illustrate a printing fluid container implementing one example of a pressure excursion bag.
Figure 1A:
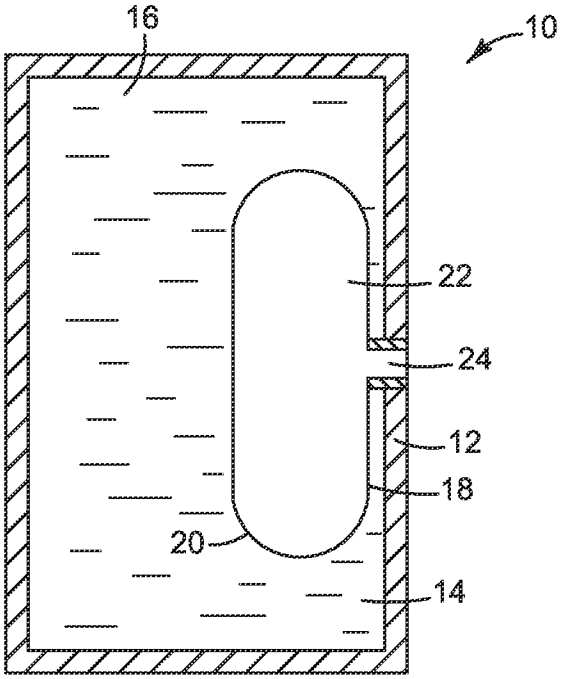
Figure 2:
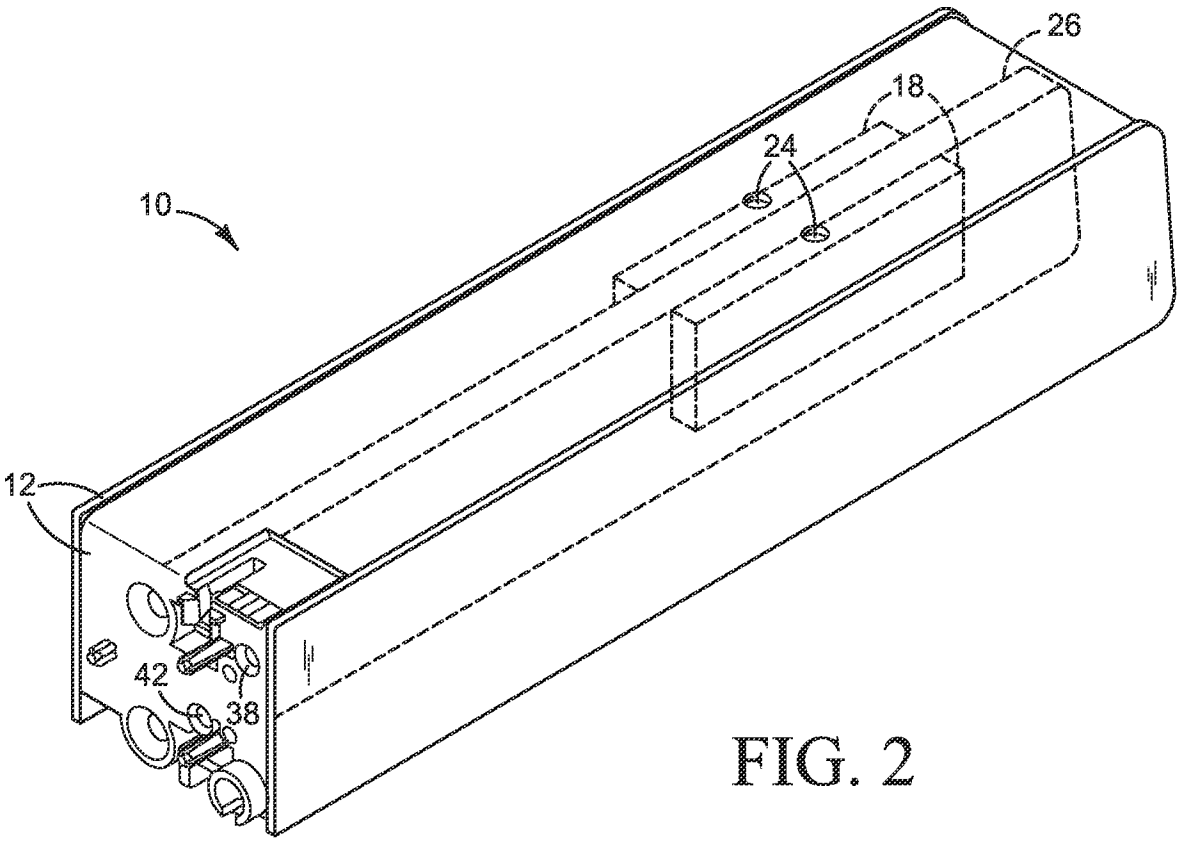
FIGS. 2-5 illustrate one example of a multi-chamber printing fluid container implementing multiple pressure excursion bags.
Figure 3:
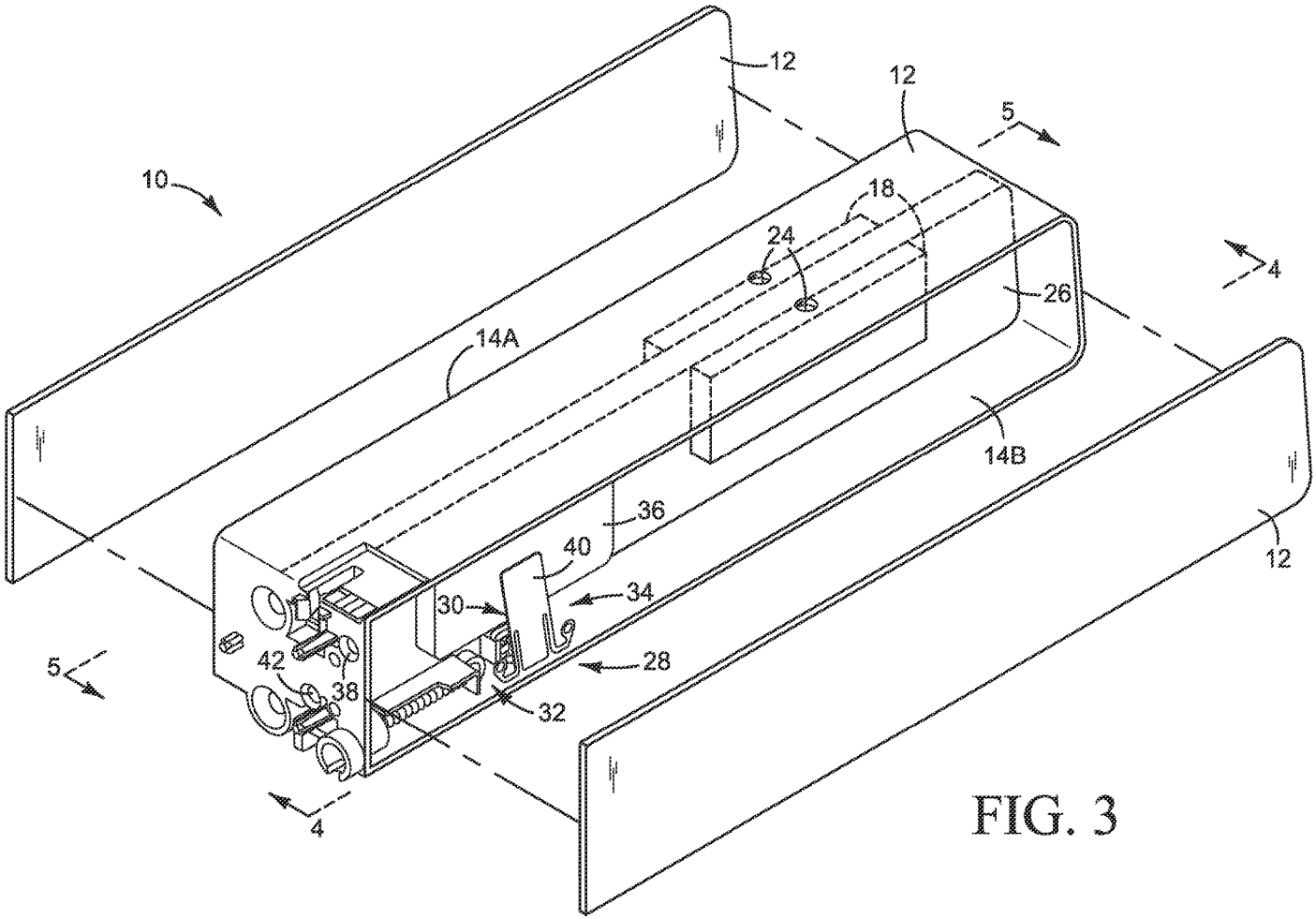
Figure 4:
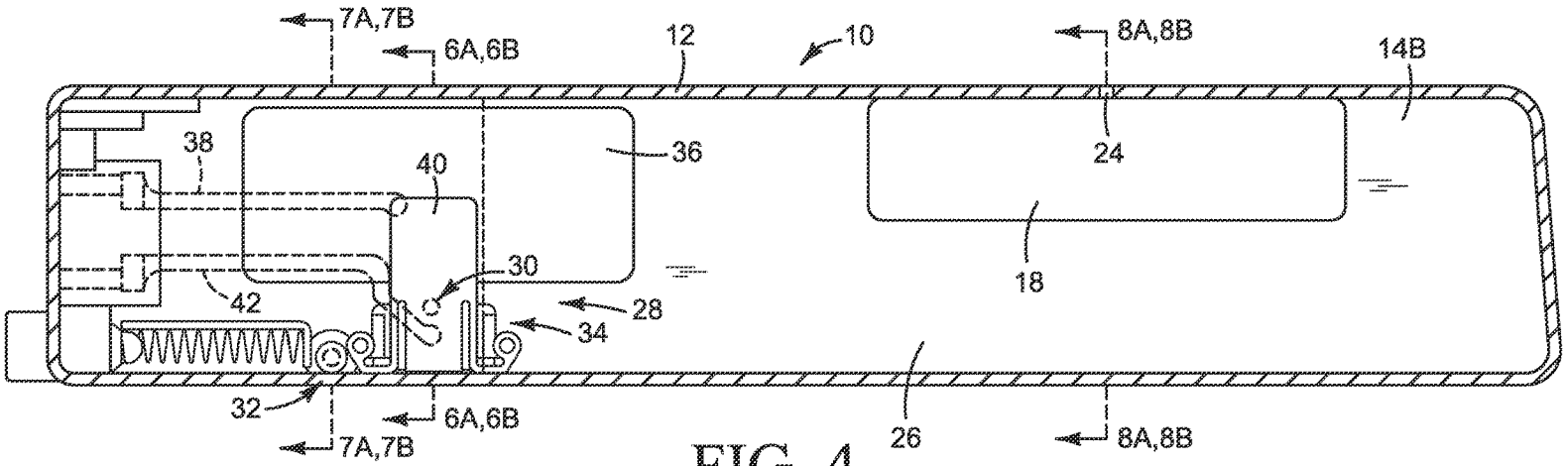
Figure 5:
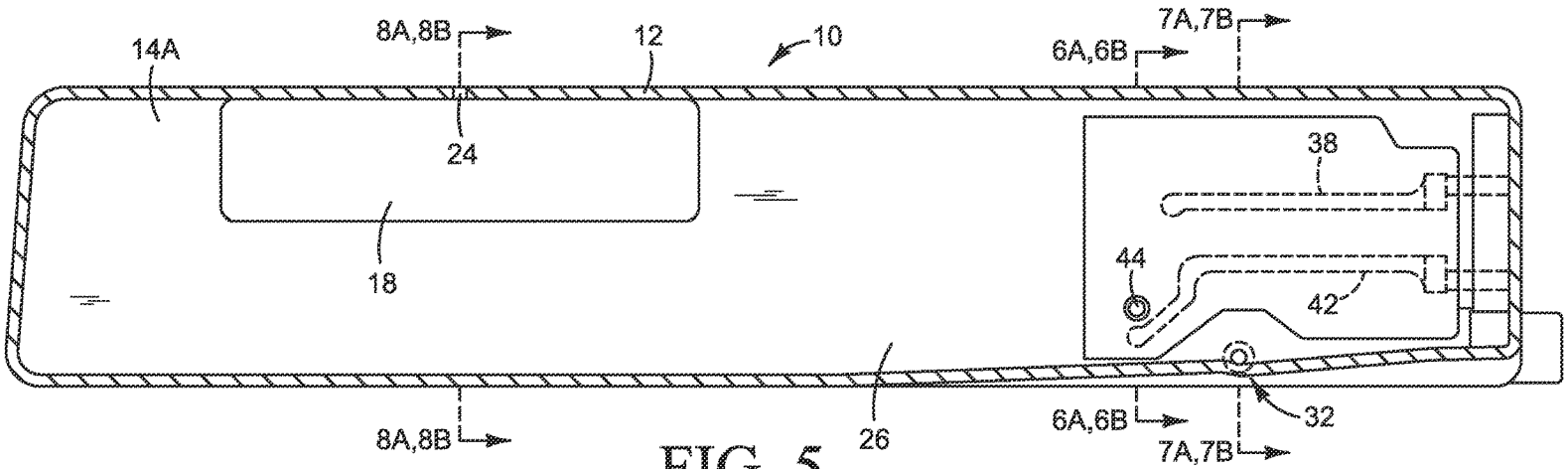

FIGS. 1A and 1B illustrate a printing fluid container implementing one example of a new pressure excursion bag. Referring to FIGS. 1A and 1B, container 10 includes a housing 12 defining an internal chamber 14 holding printing fluid 16. An inelastic, inflatable, and deflatable bag 18 occupies space in chamber 14. Bag 18 can expand and contract inside chamber 14. The exterior 20 of bag 18 is exposed to the environment inside chamber 14. The interior 22 of bag 18 is sealed against the environment inside chamber 14 and vented to the atmosphere through an opening 24 in container housing 12. FIG. 1A shows container 10 under normal conditions in which printing fluid 16 is liquid and chamber 14 is under a slight back pressure so that bag 18 is inflated to full expansion. FIG. 1B shows container 10 in an abnormal condition in which printing fluid 16 is frozen and has expanded to raise the pressure in chamber 14 and deflate and contract bag 18.

The volume of bag 18 may be unrestrained except by the environmental conditions inside chamber 14. Bag 18 may itself constructed to offer negligible resistance to expanding/inflating and contracting/deflating. The exterior of bag 18 may be able to withstand prolonged exposure to printing fluid 16. Suitable materials for constructing bag 18 may include, for example, a polyethylene protective covering on an EVOH (ethylene vinyl alcohol), metal foil or other vapor barrier.

Referring now to the multi-chamber printing fluid container shown in FIGS. 2-5, in this example container 10 includes a housing 12 defining internal chambers 14A and 14B holding printing fluid 16. An inelastic, expandable and contractible pressure excursion bag 18 occupies space in each chamber 14A, 14B. The exterior 20 (FIGS. 8A, 8B) of bag 18 is exposed to the environment inside chamber 14. The interior 22 (FIGS. 8A, 8B) of each bag 18 is sealed against the environment inside the respective chamber 14A, 14B and vented to the atmosphere through an opening 24 in container housing 12. In the example shown, each bag 18 is located inboard against a partition 26 separating the two chambers, and vented through the top of the housing. Other configurations are possible. For example, bags 18 could be located outboard in each chamber and vented through the side of the housing.

Figure 6B:
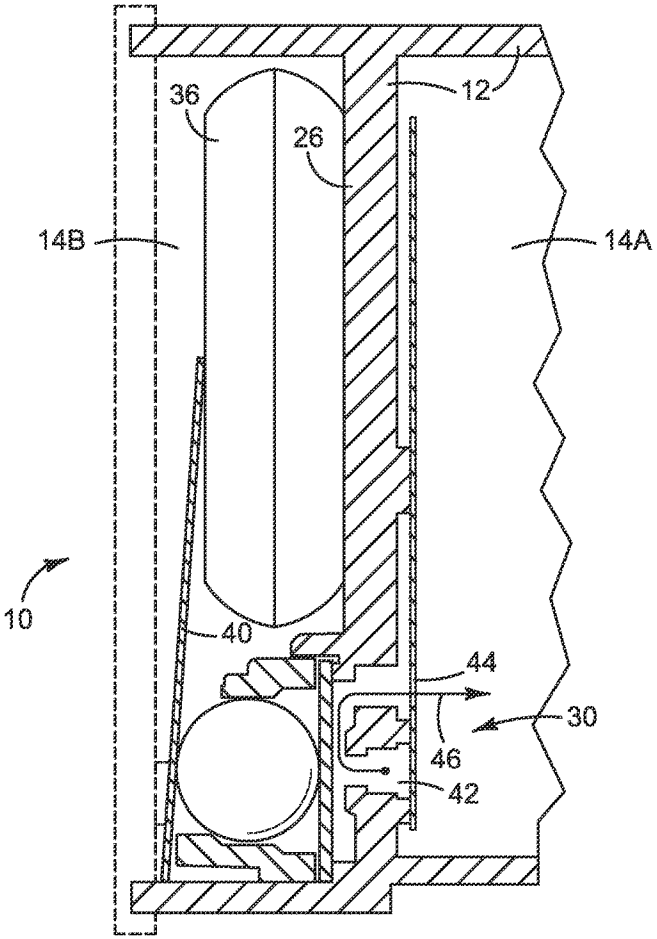
FIGS. 6A, 6B illustrate an example of sections taken along the line 6A, 6B-6A, 6B in FIGS. 4 and 5 illustrating the operation of an air valve in the flow regulator in the container shown in FIGS. 2-5.
Figure 6A:
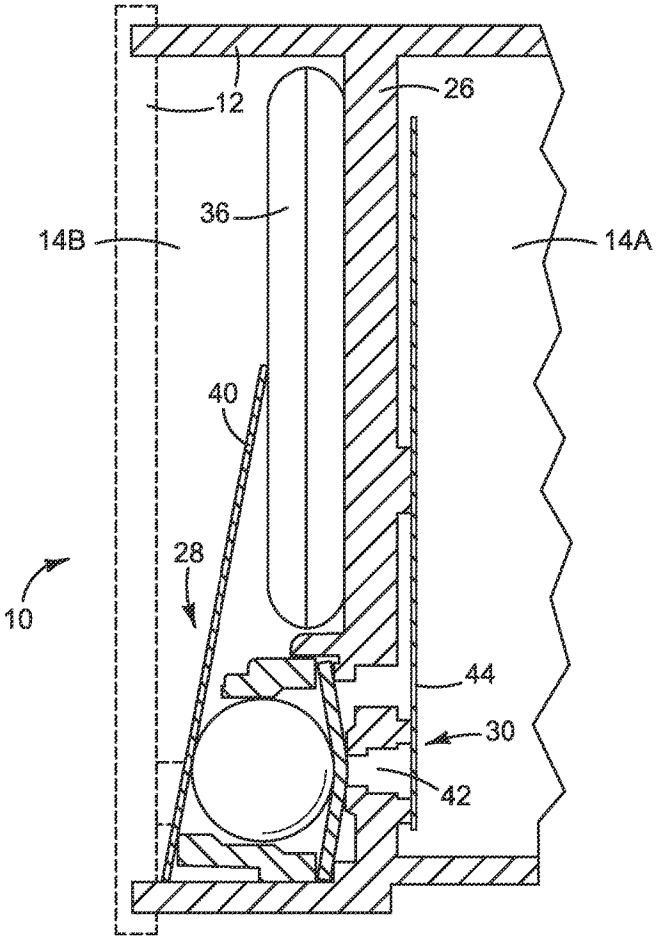
Figure 7B:
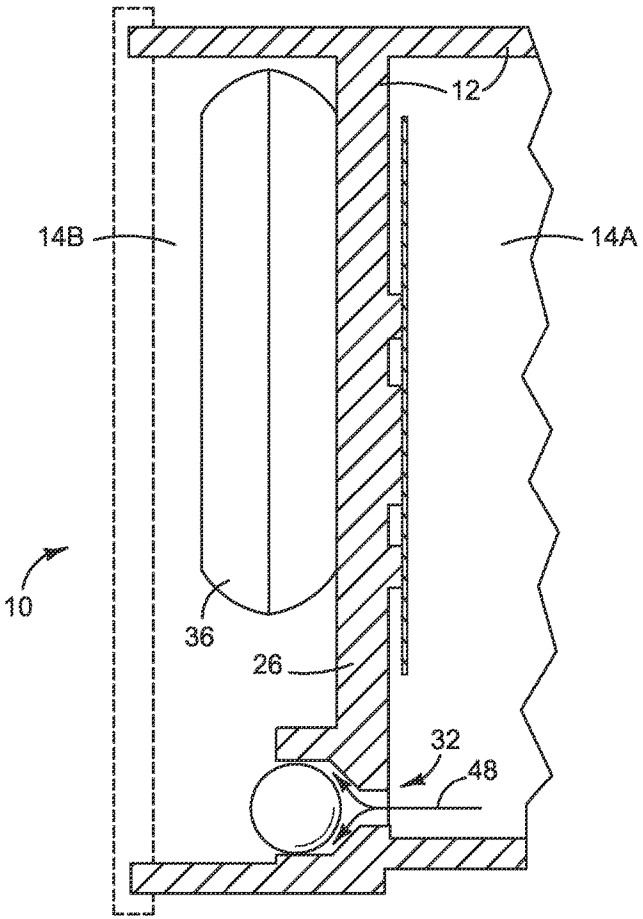
FIGS. 7A, 7B illustrate an example of sections taken along the line 7A, 7B-7A, 7B in FIGS. 4 and 5 illustrating the operation of a printing fluid valve in the flow regulator in the container shown in FIGS. 2-5.
Figure 7A:
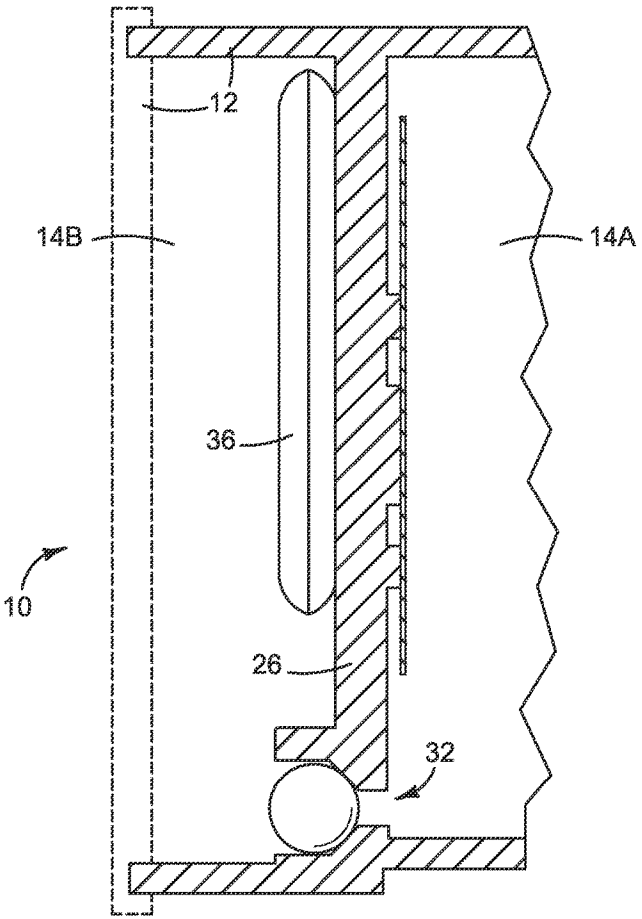

Supply chamber 14B receives printing fluid 16 from reserve chamber 14A and supplies printing fluid 16 to a printhead or other downstream component. A regulator 28 controls the flow of printing fluid 16 from reserve chamber 14A to supply chamber 14B, and helps regulate the pressure in both chambers 14A and 14B. Regulator 28 includes an air valve 30 through which air moves between chambers 14A and 14B, a printing fluid valve 32 through which printing fluid 16 flows from chamber 14A to chamber 14B, and an actuator 34 to control valve 30. Air valve 30 is seen in detail in the sections of FIGS. 6A and 6B. Printing fluid valve 32 is seen in detail in the sections of FIGS. 7A and 7B.

Referring now also to FIGS. 6A, 6B and 7A, 7B, actuator 34 (FIGS. 3 and 4) includes an expandable, contractible bag 36 vented to the atmosphere through a conduit 38 (FIG. 4) and a spring lever 40 biased against bag 36. As printing fluid is consumed and the volume of printing fluid 16 in supply chamber 14B decreases, the back pressure (vacuum) in chambers 14A and 14B increases until the atmospheric pressure acting on bag 36 through vent 38 overcomes the biasing force of spring lever 40 to expand bag 36 and open valve 30, as best seen by comparing FIGS. 6A and 6B. Outside air can then enter reserve chamber 14A through a conduit 42, the open air valve 30 and an air port 44, as indicated by air flow arrow 46 in FIG. 6B. The resulting increase in pressure in reserve chamber 14A opens printing fluid valve 32, as best seen by comparing FIGS. 7A and 7B. Printing fluid 16 flows from reserve chamber 14A into supply chamber 14B through the open printing fluid valve 32, as indicated by printing fluid flow arrow 48 in FIG. 7B, reducing the back pressure (vacuum) in chamber 14B until regulator bag 36 contracts at the urging of spring lever 40 and valve 30 closes.

Figure 8B:
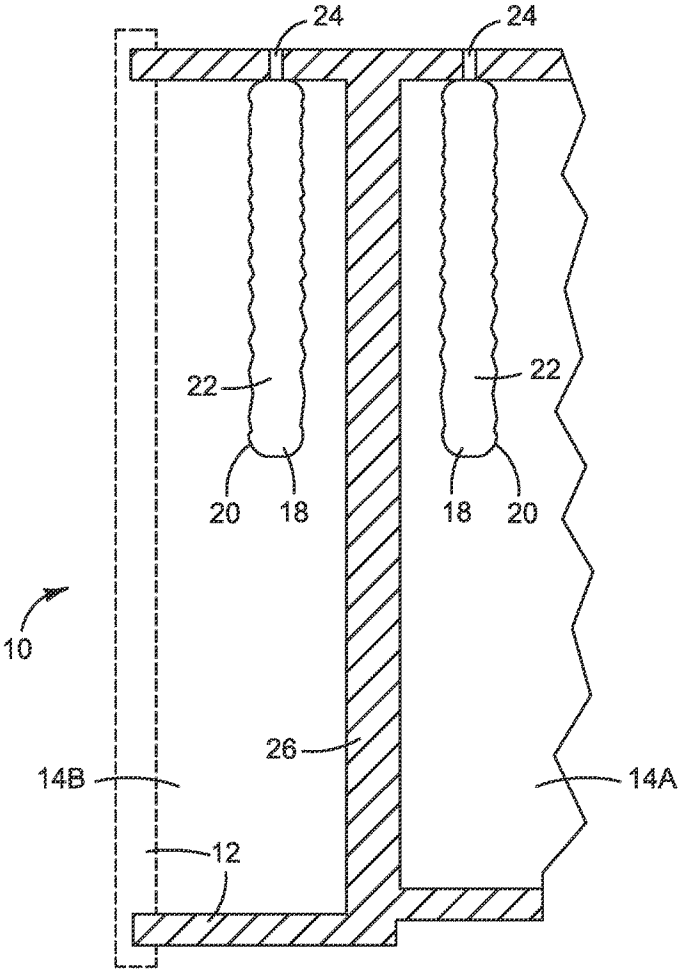
FIGS. 8A, 8B illustrate an example of sections taken along the line 8A, 8B-8A, 8B in FIGS. 4 and 5 illustrating the operation of the pressure excursion bags in the container shown in FIGS. 2-5.
Figure 8A:
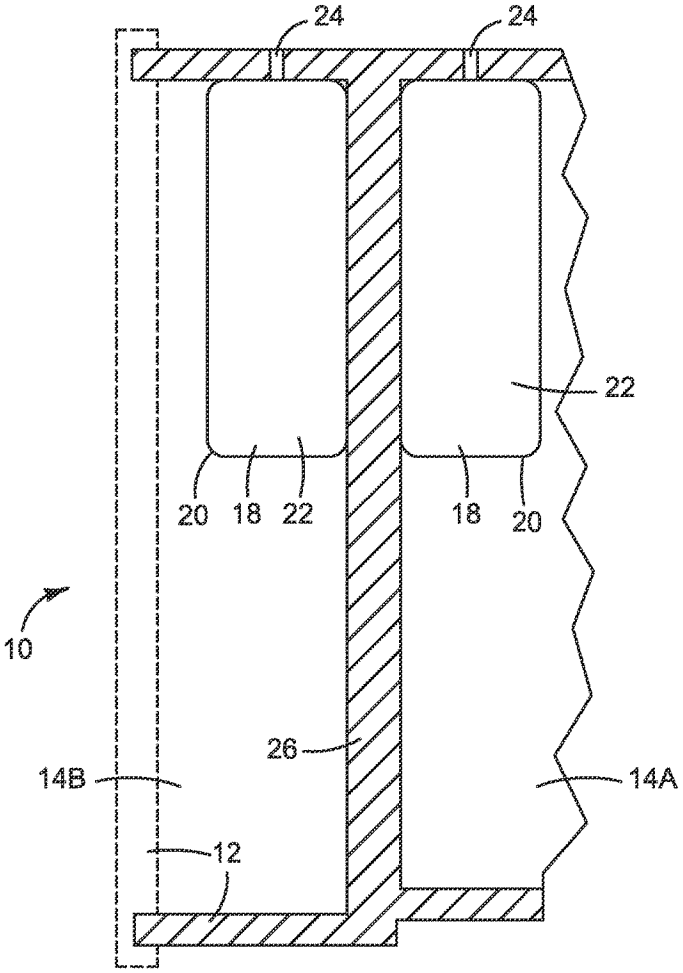

The operation of excursion bags 18 in chambers 14A, 14B is illustrated in FIGS. 8A and 8B. FIG. 8A shows container 10 under normal conditions in which each chamber 14A, 14B is under a slight back pressure so that each bag 18 is inflated to full expansion. FIG. 8B shows container 10 in an abnormal condition in which the back pressure (vacuum) in each chamber 14A, 14B is lost, the pressure inside each chamber has risen above atmospheric pressure and bags 18 have deflated and contracted to neutralize the abnormality. Unlike the volume of regulator bag 36, which is restrained by spring lever 40, the volume of each bag 18 is unrestrained so that each excursion bag 18 will remain fully inflated throughout the full range of back pressures existing inside chambers 14A, 14B under normal conditions. Bags 18 will not deflate and contract except in the event of abnormally high pressure in the chambers.

As noted above, each excursion bag 18 is itself constructed to offer negligible resistance to expanding/inflating and contracting/deflating. Inkjet printing fluid containers normally operate with a slight back pressure, for example in the range of $0 inH_2O$ to $-15 inH_2O$. Thus, within this range of normal operating pressures a pressure excursion bag 18 vented to the atmosphere will inflate to full expansion and will remain fully inflated until the pressure inside the container exceeds 0 gage (atmospheric pressure). If the pressure inside the container rises above 0 gage, bag 18 will begin to deflate and contract to create more space inside the container for expanding air and/or liquid, relieving any further increase in pressure until the bag is completely deflated.

While a single pressure excursion bag 18 is shown in each chamber 14A and 14B, other configurations are possible. For example, it may be desirable in some implementations to have a pressure excursion bag 18 in just one chamber 14A, 14B or to have multiple bags 18 in one or both chambers 14A and 14B. Also, the use of a pressure excursion bag is not limited to a single chamber container, such as container 10 shown in FIG. 1, or a dual chamber container, such as that shown in FIGS. 2-5, but may be implemented in other types of printing fluid containers.

As noted at the beginning of this Description, the examples shown in the figures and described above illustrate but do not limit the scope of the patent. Other examples are possible. Therefore, the foregoing description should not be construed to limit the scope of the patent, which is defined in the following Claims.

"A" and "an" as used in the Claims means one or more.

What is claimed is:

1. A printing fluid container, comprising:
a chamber to hold a printing fluid; and
an inelastic, expandable, and contractible excursion bag occupying space in the chamber, an exterior of the bag exposed to an interior of the chamber and an interior of the bag sealed against the interior of the chamber and vented to the atmosphere, a volume of the excursion bag being unrestrained in the chamber except by fluid pressure.

2. The container of claim 1, where the excursion bag is fully expandable whenever a pressure inside the chamber is less than 0 gage.

3. The container of claim 1, comprising:
an expandable and contractible regulator bag in the chamber and vented to the atmosphere; and
a spring lever biased against the regulator bag.

4. The container of claim 1, where the bag is deflatable whenever a pressure inside the chamber is above 0 gage.

5. The container of claim 1, including printing fluid in the chamber.

6. A printing fluid container, comprising:
a chamber to hold a printing fluid; and
an inflatable and deflatable air bag inside the chamber, the air bag being fully inflatable whenever a pressure inside the chamber is $0 inH_2O$ to $-15 inH_2O$.

7. The container of claim 6, where the bag is deflatable whenever the pressure inside the chamber is above 0 gage.

8. The container of claim 7, where the bag is inelastic.

9. The container of claim 8, where a volume of the bag is unrestrained in the chamber except by fluid pressure.

10. The container of claim 9, including printing fluid in the chamber.

11. A printing fluid container, comprising:
a first chamber to hold printing fluid;
a second chamber to receive printing fluid from the first chamber and to supply printing fluid to a component downstream from the container;
a regulator to regulate the flow of printing fluid from the first chamber into the second chamber; and
an inelastic, expandable, and contractible first bag occupying space in the first chamber and vented to the atmosphere; and
an inelastic, expandable, and contractible second bag occupying space in the second chamber and vented to the atmosphere.

12. The container of claim 11, where the regulator includes:
an expandable and contractible third bag in the second chamber and vented to the atmosphere; and
a spring lever biased against the third bag.

13. The container of claim 11, where the first bag is fully expandable whenever a pressure inside the first chamber is less than 0 gage and the second bag is fully expandable whenever a pressure inside the second chamber is less than 0 gage.

14. The container of claim 11, where a volume of the first bag is unrestrained in the first chamber except by fluid pressure and a volume of the second bag is unrestrained in the second chamber except by fluid pressure.

15. The container of claim 11, including printing fluid in the first and second chambers.

* * * * *